US007781954B2

(12) United States Patent
Wei et al.

(10) Patent No.: US 7,781,954 B2
(45) Date of Patent: Aug. 24, 2010

(54) PIXEL ELEMENT FOR FIELD EMISSION DISPLAY

(75) Inventors: Yang Wei, Beijing (CN); Liang Liu, Beijing (CN); Shou-Shan Fan, Beijing (CN)

(73) Assignees: Tsinghua University, Beijing (CN); Hon Hai Precision Industry Co., Ltd., Tu-Cheng, Taipei-Hsien (TW)

( * ) Notice: Subject to any disclaimer, the term of this patent is extended or adjusted under 35 U.S.C. 154(b) by 157 days.

(21) Appl. No.: 12/069,299

(22) Filed: Feb. 8, 2008

(65) Prior Publication Data

US 2009/0115309 A1 May 7, 2009

(30) Foreign Application Priority Data

Nov. 2, 2007 (CN) ..... 2007 1 0124243

(51) Int. Cl.
*H01J 1/62* (2006.01)
*H01J 63/04* (2006.01)

(52) U.S. Cl. ..... 313/495; 313/309; 313/336; 313/351; 313/346 R

(58) Field of Classification Search ..... 313/495–497, 313/309–311, 336, 351, 346 R
See application file for complete search history.

(56) References Cited

U.S. PATENT DOCUMENTS

2003/0090190 A1 * 5/2003 Takai et al. ..... 313/311
2003/0143356 A1 7/2003 Morikawa
2004/0104660 A1 * 6/2004 Okamoto et al. ..... 313/346 R
2006/0066202 A1 * 3/2006 Manohara et al. ..... 313/311
2007/0145878 A1 * 6/2007 Liu et al. ..... 313/336
2007/0284986 A1 * 12/2007 Tai et al. ..... 313/309
2008/0012466 A1 * 1/2008 Yang et al. ..... 313/495
2008/0030123 A1 * 2/2008 Yang et al. ..... 313/495
2009/0001867 A1 * 1/2009 Yang et al. ..... 313/496
2009/0115306 A1 * 5/2009 Wei et al. ..... 313/309

* cited by examiner

*Primary Examiner*—Joseph L Williams
*Assistant Examiner*—Kevin Quarterman
(74) *Attorney, Agent, or Firm*—Jeffrey T. Knap

(57) ABSTRACT

A pixel element for field emission display includes a sealed container having a light permeable portion, an anode, a cathode, a phosphor layer formed on an end surface of the anode, and a CNT string electrically connected to and in contact with the cathode with an emission portion of the CNT string suspending. The phosphor layer is opposite to the light permeable portion, and the emission portion is corresponding to the phosphor layer. Some of CNT bundles in the CNT string are taller than and project over the adjacent CNT bundles, and each of projecting CNT bundles functions as an electron emitter. The anode, the cathode, the phosphor layer and the CNT string are enclosed in the sealed container. The luminance of the pixel element is enhanced at a relatively low voltage.

18 Claims, 4 Drawing Sheets

PIXEL ELEMENT FOR FIELD EMISSION DISPLAY

RELATED APPLICATIONS

This application is related to commonly-assigned, co-pending application: U.S. Patent Application Ser. No. 12/069,313, entitled "METHOD FOR MANUFACTURING FIELD EMISSION ELECTRON SOURCE HAVING CARBON NANOTUBE", filed Feb. 8, 2008 and U.S. patent application Ser. No. 12/069,300, entitled "METHOD FOR MANUFACTURING FIELD EMISSION ELECTRON SOURCE HAVING CARBON NANOTUBE", filed Feb. 8, 2008.

BACKGROUND

1. Field of the Invention

The invention relates to pixel elements and, particularly, to a pixel element for a field emission display.

2. Discussion of Related Art

Field emission displays (FEDs) are based on emission of electrons in vacuum. Electrons are emitted from micron-sized tips in a strong electric field, and the electrons are accelerated and bombard a fluorescent material, and then the fluorescent material emits visible light. FEDs are thin, light weight, and provide high levels of brightness.

Carbon nanotubes (CNTs) produced by means of arc discharge between graphite rods were first discovered and reported in an article by Sumio Iijima, entitled "Helical Microtubules of Graphitic Carbon" (Nature, Vol. 35, Nov. 7, 1991, pp. 56-58). CNTs also feature extremely high electrical conductivity, very small diameters (much less than 100 nanometers), large aspect ratios (i.e. length/diameter ratios) (greater than 1000), and a tip-surface area near the theoretical limit (the smaller the tip-surface area, the more concentrated the electric field, and the greater the field enhancement factor). These features tend to make CNTs ideal candidates for electron emitter in FED. However, single CNT is so tiny in size and then the controllability of the method manufacturing is less than desired. Further, the luminous efficiency of the FED is low due to the shield effect caused by the adjacent CNTs.

What is needed, therefore, is a pixel element for FED, which has high luminous efficiency and can be easily manufactured.

SUMMARY

A pixel element for field emission display includes a sealed container having a light permeable portion, an anode, a cathode, a phosphor layer formed on an end surface of the anode, and a CNT string electrically connected to and in contact with the cathode with an emission portion of the CNT string suspending. The phosphor layer is opposite to the light permeable portion, and the emission portion is corresponding to the phosphor layer. Some of CNT bundles in the CNT string are taller than and project over the adjacent CNT bundles, and each of projecting CNT bundles functions as an electron emitter. The anode, the cathode, the phosphor layer and the CNT string are enclosed in the sealed container.

Compared with the conventional pixel element, the present pixel element has the following advantages: using CNT string as the electron emitter, and thus the pixel element is more easily fabricated. Further, the emission portion of the CNT string is in a tooth-shape structure, which can prevent from the shield effect caused by the adjacent CNT bundles, and the luminous efficiency of the pixel element is improved.

Other advantages and novel features of the present pixel element will become more apparent from the following detailed description of preferred embodiments when taken in conjunction with the accompanying drawings.

BRIEF DESCRIPTION OF THE DRAWINGS

Many aspects of the present pixel element can be better understood with reference to the following drawings. The components in the drawings are not necessarily to scale, the emphasis instead being placed upon clearly illustrating the principles of the present pixel element.

Figure 1:
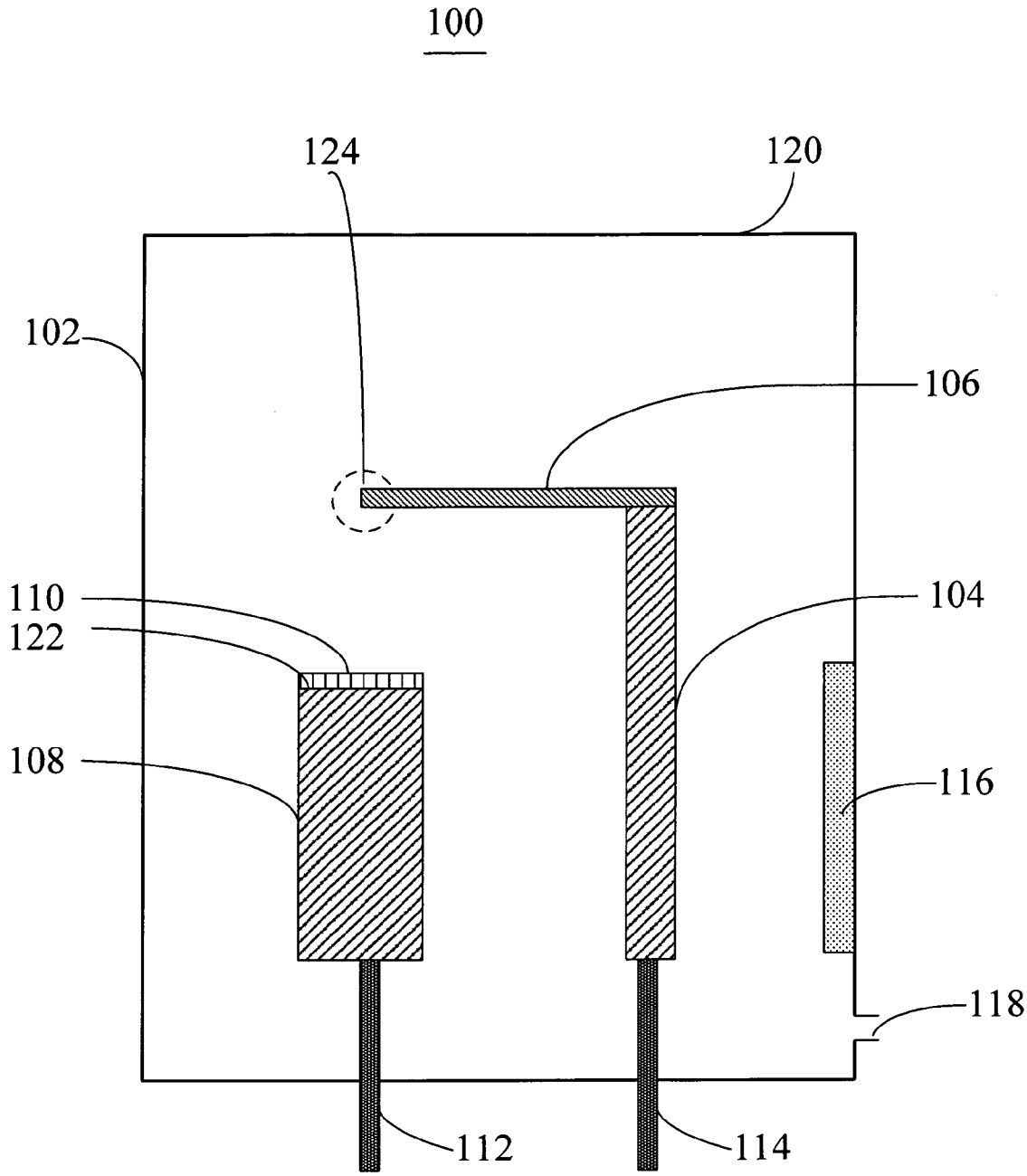
FIG. 1 is a schematic, cross-sectional view of a pixel element according to an embodiment.

Corresponding reference characters indicate corresponding parts throughout the several views. The exemplifications set out herein illustrate at least one preferred embodiment of the pixel element, in one form, and such exemplifications are not to be construed as limiting the scope of the invention in any manner.

DETAILED DESCRIPTION OF PREFERRED EMBODIMENTS

Reference will now be made to the drawings to describe, in detail, the preferred embodiments of the present pixel element for field emission display.

Referring to FIG. 1, a pixel element 100 for a FED includes a sealed container 102 having a light permeable portion 120, a cathode 104, a CNT string 106, an anode 108, a phosphor layer 110, an anode terminal 112 and a cathode terminal 114. The cathode 104, the CNT string 106, the anode 108, the phosphor layer 110, the anode terminal 112 and the cathode terminal 114 are all enclosed in the sealed container 102. The cathode 104, the anode 108, the anode terminal 112 and the cathode terminal 114 are made of thermally and electrically conductive materials.

The cathode 104 is electrically connected to a cathode terminal 114, and the anode 108 is electrically connected to an anode terminal 112. The anode terminal 112 and the cathode terminal 114 run from the inside to the outside of the sealed container 102, and are supplied with the power source.

The sealed container 102 is a hollow member that defines an inner space in vacuum. The cross section of the sealed container 102 has a shape selected from a group consisting of circular, ellipsoid, quadrangular, triangular, polygonal and so on. The sealed container 102 may be comprised of any non-metallic material, and the light permeable portion 120 need be made of a transparent material. In the present embodiment, the sealed container 102 is a hollow cylinder and comprised of quartz or glass. A diameter of the sealed container 102 is about 2-10 millimeters (mm), and a height thereof is about 5-50 mm. The light permeable portion 120 has a surface selected from the group consisting of a plane surface, a spherical surface and an aspherical surface.

The anode 108 is made of a metal material. The phosphor layer 110 with a thickness of about 5-50 microns (μm) is formed on the end surface 122 of the anode 108. The phosphor layer 110 may be a white phosphor layer, or a color phosphor layer, such as red, green or blue. The end surface 122 is a polished metal surface or a plated metal surface, and thus can reflect the light beams emitted from the phosphor layer 110 to the permeable portion 120 to enhance the brightness of the pixel element 100.

The CNT string 106 is electrically connected to and in contact with the cathode 104 by a conductive paste, such as silver paste, with an emission portion 124 of the CNT string 106 suspending. The phosphor layer 110 is opposite to the light permeable portion 120, and the emission portion 124 is corresponding to the phosphor layer 110. A distance between the emission portion 124 and the phosphor layer 110 is less than 5 mm. The emission portion 124 can be arranged perpendicular to the phosphor layer 110, parallel to phosphor layer 110 or inclined to phosphor layer 110 with a certain angle. In the present embodiment, the emission portion 124 is parallel to phosphor layer 110, and arranged between the phosphor layer 110 and the light permeable portion 120. The cathode 104 is made of an electrically conductive material, such as nickel, copper, tungsten, gold, molybdenum or platinum.

The CNT string 106 is composed of a number of closely packed CNT bundles, and each of the CNT bundles includes a number of CNTs, which are substantially parallel to each other and are joined by van der Waals attractive force. A diameter of the CNT string 106 is in an approximate range from 1 to 100 microns (μm), and a length thereof is in an approximate range from 0.1-10 centimeters (cm).

Figure 2:
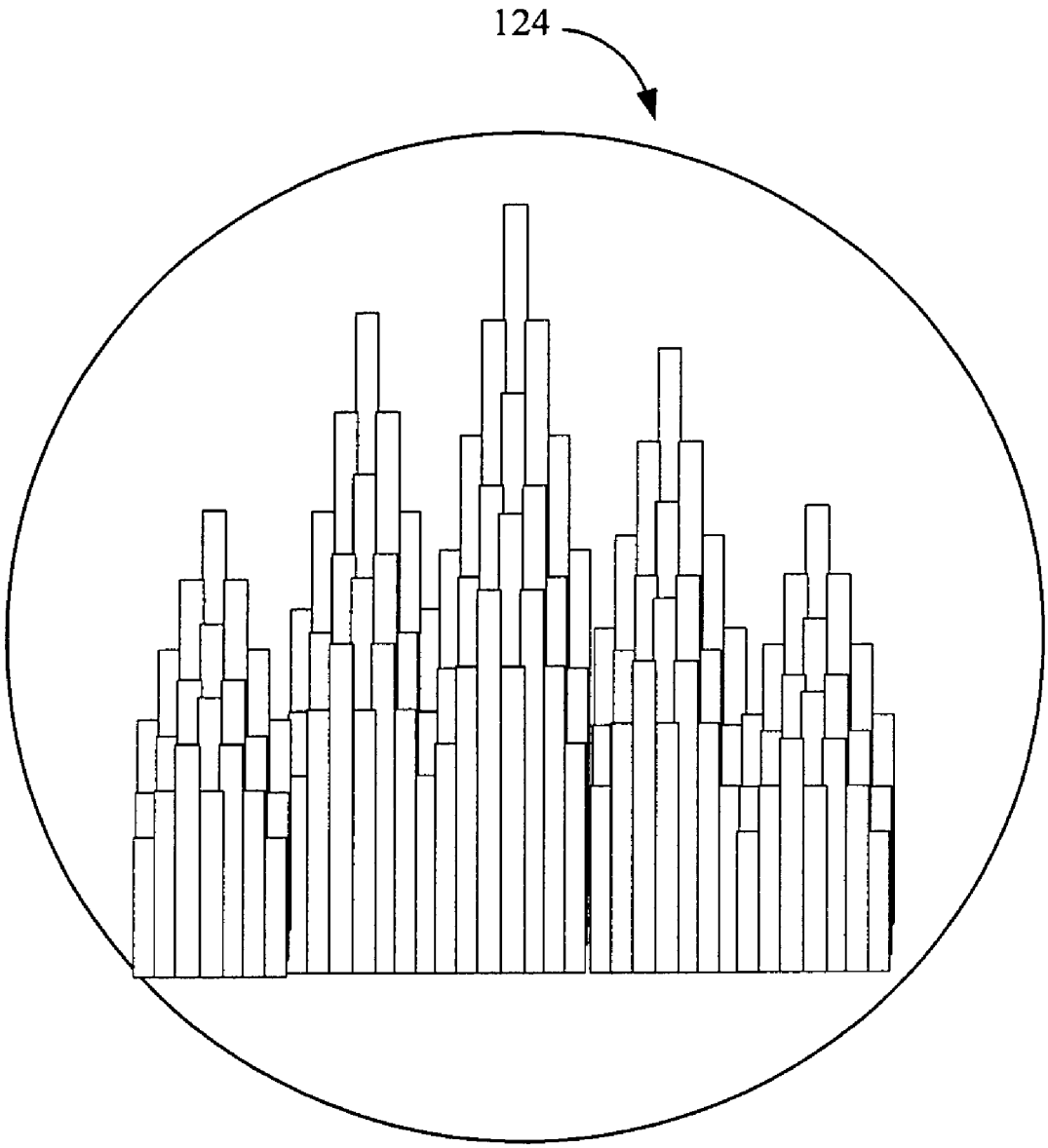
FIG. 2 is a schematic, amplificatory view of part II in FIG. 1.
Figure 3:
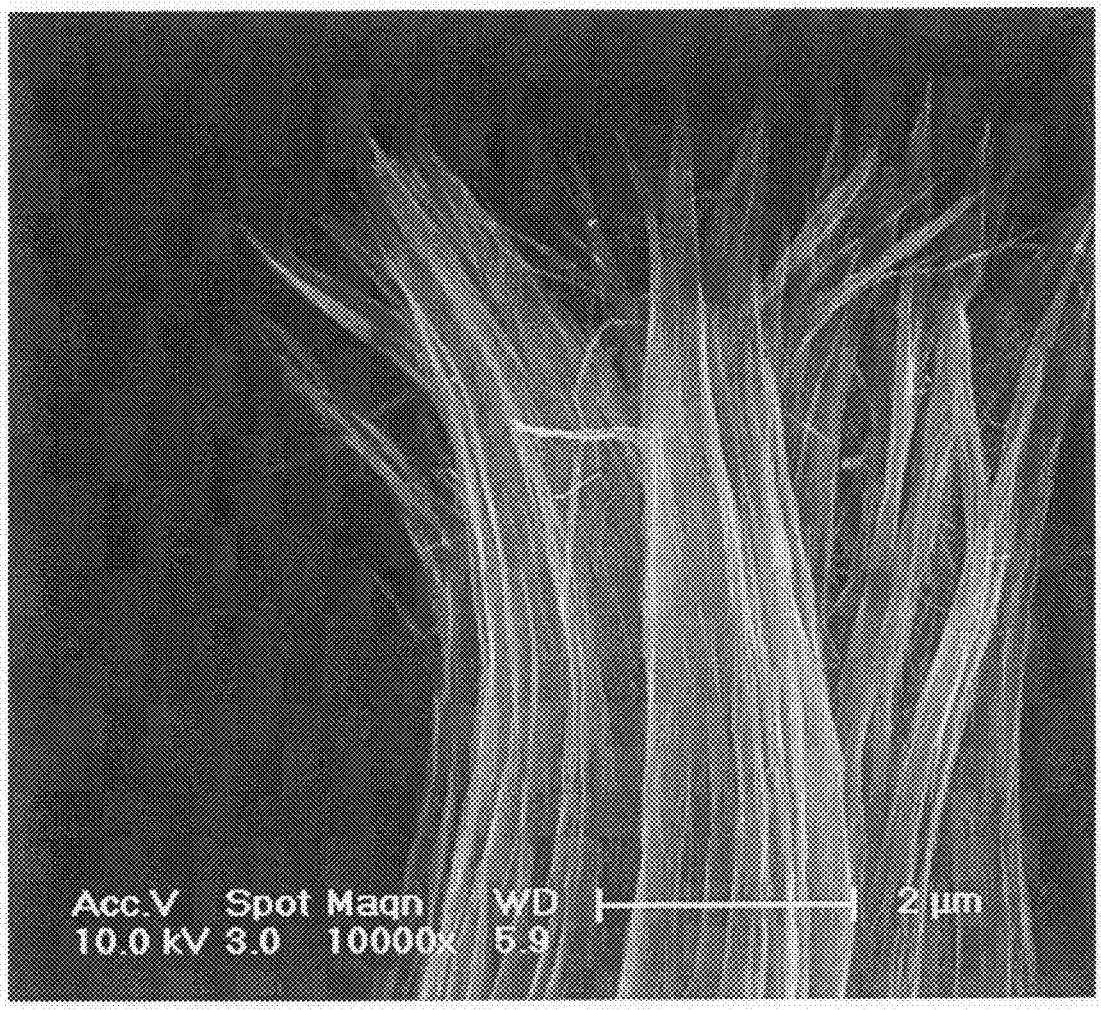
FIG. 3 is a Scanning Electron Microscope (SEM) image, showing part II in FIG. 1.
Figure 4:
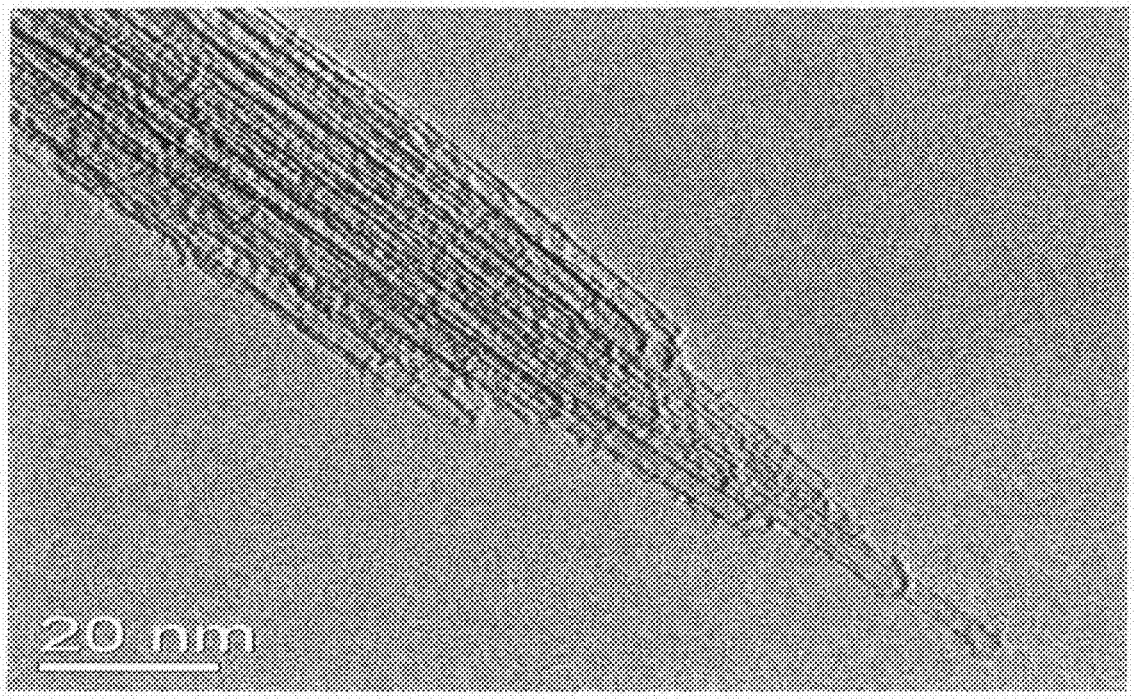
FIG. 4 is a Transmission Electron Microscope (TEM) image, showing art II in FIG. 1.

Referring to FIGS. 2, 3 and 4, the CNTs at the emission portion 124 form a tooth-shaped structure, i.e., some of CNT bundles being taller than and projecting above the adjacent CNT bundles. Therefore, a shield effect caused by the adjacent CNTs can be reduced. The field emission efficiency of the CNT string 106 is improved. The CNTs at the emission portion 124 have smaller diameter and fewer number of graphite layer, typically, less than 5 nanometer (nm) in diameter and about 2-3 in wall. However, the CNTs in the CNT string 106 other than the emission portion 124 are about 15 nm in diameter and have more than 5 walls.

A method for making the CNT string 106 is taught in U.S. Application Ser. No. 12/006,305, entitled "METHOD FOR MANUFACTURING FIELD EMISSION ELECTRON SOURCE HAVING CARBON NANOTUBES", filed Dec. 29, 2007 which is incorporated herein by reference. The CNT string 106 can be drawing a bundle of CNTs from a super-aligned CNT array to be held together by van der Waals force interactions. Then, the CNT string 106 is soaked in an ethanol solvent, and thermally treated by supplying a current thereto. After the above processes, the CNT string 106 has improved electrical conducting and mechanical strength.

In operation, a positive bias is applied, an electric field is formed between the cathode 104 and the anode 108, and electrons are emitted from the emission portion 124 of the CNT string 106. The emitted electrons are attracted to the positively charged anode 108, the electrons bombard the phosphor layer 110 and visible light is emitted from the phosphor layer 110. Part of the light is directly transmitted through the light permeable portion 120, and part of the light is reflected from the end surface 122 and then transmitted out of the light permeable portion 120. Using the CNT string 106, the luminance of the pixel element 100 is enhanced at a relatively low voltage.

The pixel element 100 may further includes a getter 116 configured for absorbing residual gas inside the sealed container 102 and maintaining the vacuum in the inner space of the sealed container 102. More preferably, the getter 116 is arranged on an inner surface of the sealed container 102. The getter 116 may be an evaporable getter introduced using high frequency heating. The getter 116 also can be a non-evaporable getter.

The pixel element 100 may further includes an air vent 118. The air vent 118 can be connected with a gas removal system (not shown) such as, for example, a vacuum pump for creating a vacuum inside the sealed container 102. The pixel element 100 is evacuated to obtain the vacuum by the gas removal system through the air vent 118, and then sealed. A number of pixel elements 100 can be easily assembled into a large-area FED.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A pixel element, the pixel element comprising:

a sealed container having a light permeable portion;

an anode;

a cathode spaced from the light permeable portion;

a phosphor layer formed on the anode and spaced to the light permeable portion;

a cathode emitter perpendicularly extending from a top end of the cathode and beyond the cathode, wherein a first portion of the cathode emitter is in contact with the top end of the cathode, and a second portion of the cathode emitter extends to and above the anode, and the cathode emitter is parallel to the permeable portion.

2. The pixel element as claimed in claim 1, wherein the cathode emitter is a CNT string electrically connected to and in contact with the cathode, an emission portion of the CNT string is suspended above the anode, the emission portion corresponds to the phosphor layer, and at least some of CNT bundles in the CNT string are taller than adjacent CNT bundles, and function as an electron emitter.

3. The pixel element as claimed in claim 1, wherein the second portion is arranged between the phosphor layer and the light permeable portion.

4. The pixel element as claimed in claim 2, wherein a diameter of the CNT string is in an approximate range from 1 to 100 microns, and a length of the CNT string is in an approximate range from 0.1-10 centimeters.

5. The pixel element as claimed in claim 2, wherein each of the CNT bundles comprises a plurality of CNTs, the CNTs are substantially parallel to each other and are joined by van der Waals attractive force.

6. The pixel element as claimed in claim 5, wherein the CNTs at the emission portion have a diameter of less than 5 nanometers and a number of graphite layer of about 2-3.

7. The pixel element as claimed in claim 5, wherein the CNTs in the CNT string other than the emission portion have a diameter of about 15 nanometers and a number of graphite layer of more than 5.

8. The pixel element as claimed in claim 1, further comprising an anode terminal and a cathode terminal, wherein the anode terminal is electrically connected to the anode, and the cathode terminal is electrically connected to the cathode respectively.

9. The pixel element as claimed in claim 8, wherein the anode terminal and the cathode terminal run from the inside to the outside of the sealed container.

10. The pixel element as claimed in claim 8, wherein the cathode, the anode, the cathode terminal and the anode terminal are made of thermally and electrically conductive materials.

11. The pixel element as claimed in claim 10, wherein the anode is made of a metal material, and an end surface of the anode is a polished metal surface or a plated metal surface.

12. The pixel element as claimed in claim 1, wherein the sealed container is a hollow member that defines an inner space in vacuum.

13. The pixel element as claimed in claim 1, wherein the sealed container is comprised of quartz or glass.

14. The pixel element as claimed in claim 1, wherein a diameter of the sealed container is about 2-10 millimeters, and a height thereof is about 5-50 millimeters.

15. The pixel element as claimed in claim 1, wherein the light permeable portion has a surface selected from the group consisting of a plane surface, a spherical surface and an aspherical surface.

16. The pixel element as claimed in claim 1, wherein the cathode emitter is electrically connected to and in contact with the cathode by a conductive paste.

17. The pixel element as claimed in claim 1, wherein a distance between the second portion and the phosphor layer is less than 5 millimeters.

18. The pixel element as claimed in claim 1, further comprising a getter, wherein the getter is arranged on an inner surface of the sealed container.

* * * * *